US011203367B2

(12) United States Patent
McMahon

(10) Patent No.: US 11,203,367 B2
(45) Date of Patent: Dec. 21, 2021

(54) CONTROL SYSTEM FOR SIGNALS AT RAILROAD GRADE CROSSINGS

(71) Applicant: AUTO TRUCK GROUP, LLC, Bartlett, IL (US)

(72) Inventor: Patrick William McMahon, Streamwood, IL (US)

(73) Assignee: Auto Truck Group, LLC, Bartlett, IL (US)

( * ) Notice: Subject to any disclaimer, the term of this patent is extended or adjusted under 35 U.S.C. 154(b) by 298 days.

(21) Appl. No.: 16/394,181

(22) Filed: Apr. 25, 2019

(65) Prior Publication Data

US 2019/0337542 A1 Nov. 7, 2019

Related U.S. Application Data

(60) Provisional application No. 62/665,575, filed on May 2, 2018.

(51) Int. Cl.
*B61L 7/08* (2006.01)
*B61L 13/04* (2006.01)

(52) U.S. Cl.
CPC ..... *B61L 13/04* (2013.01); *B61L 7/08* (2013.01)

(58) Field of Classification Search
CPC .. B61L 13/04; B61L 7/08; B61L 15/00; B61L 1/183; B60L 5/08; B60L 5/085
See application file for complete search history.

(56) References Cited

U.S. PATENT DOCUMENTS 2,853,957 A * 9/1958 Dean ..... B61L 23/10 104/279
5,208,499 A * 5/1993 Barber ..... H02K 5/148 310/51
6,533,222 B1 * 3/2003 Brooks ..... B61L 1/183 246/25
7,880,362 B2 * 2/2011 Cutsforth ..... H01R 39/381 310/239

FOREIGN PATENT DOCUMENTS

FR 860539 * 1/1941

OTHER PUBLICATIONS

AZO Materials—Grade 304L Stainless Steel (Year: 2009).*

* cited by examiner

*Primary Examiner* — Mark T Le

(74) *Attorney, Agent, or Firm* — Gregory J. Winsky, Esquire; Archer & Greiner, P.C.

(57) ABSTRACT

An improved safety system used to determine the present position of a car riding on railroad tracks that provides data to control signals, such as flashing lights, and crossing gates at railroad grade crossings in order to prevent accidents with vehicles or persons.

4 Claims, 10 Drawing Sheets

CONTROL SYSTEM FOR SIGNALS AT RAILROAD GRADE CROSSINGS

CROSS REFERENCE TO RELATED APPLICATION

This application claims priority from U.S. Provisional Application No. 62/665,575 filed on May 2, 2018.

FIELD OF THE INVENTION

The instant invention relates to safety systems that determine the present position of railcars on railroad tracks are critical in providing data to control signals, such as flashing lights, and crossing gates at railroad grade crossings in order to prevent accidents with vehicles or persons.

BACKGROUND OF THE INVENTION

When railcars are on railroad tracks, electrical continuity between the two rails can be allowed or insulated in order to trigger crossing gates and determine position on the track. Shunts are a part of the electro-mechanical system that allow continuity to be turned on and off by completing the circuit between the track and the wheels of the railcar or breaking that circuit. Since the wheels of the railcar are spinning, a system must be put in place to allow for the completion an electrical circuit with a spinning conductor, that is, with a spinning rail wheel.

SUMMARY OF THE INVENTION

When railcars are on railroad tracks, electrical continuity between the two rails can be allowed or insulated in order to trigger crossing gates and determine position on the track. Shunts are a part of the electro-mechanical system that allows continuity to be turned on and off by completing the circuit between the track and the wheels of the railcar or breaking that circuit. Since the wheels of the railcar are spinning, a system must be put in place to allow for the completion an electrical circuit with a spinning conductor, that is, with a spinning rail wheel. An example of a prior art system that is used to complete an electrical circuit with a spinning rail wheel is shown in FIGS. 1*a*, 1*b*, and 1*c*. FIG. 1*a* shows a conductive metal wire brush 100. The wire brush is in contact with, by riding on, the rail wheel outer edge 101 as shown in FIGS. 1*b* and 1*c* as the wheel spins as the rail car rides the tracks. The problem with the prior art system shown in these figures is that the constant contact between the wire brush 100 and the outside edge of the rail wheel 101 causes both part to wear more quickly than were the system not in place, with the result that the brush and the rail wheel require replacement more quickly than would otherwise be the case.

The invention described herein solves the problem of frequent replacement of brushes and rail wheels by utilizing a contact shoe that rides on the inside surface of the rail wheel hub to make an electrical contact through spinning components in contact with the rail. A wire is connected to the stationary shunt contact shoe that allows control of connectivity allowing the shunt components to be protected by the rail wheel, eliminating wear on the outer surface of the rail wheel and providing a reliable connection. The contact shoe is the wear/replacement part which is significantly less expensive than the parts used in previous designs.

DETAILED DESCRIPTION OF THE INVENTION

Figure 2:
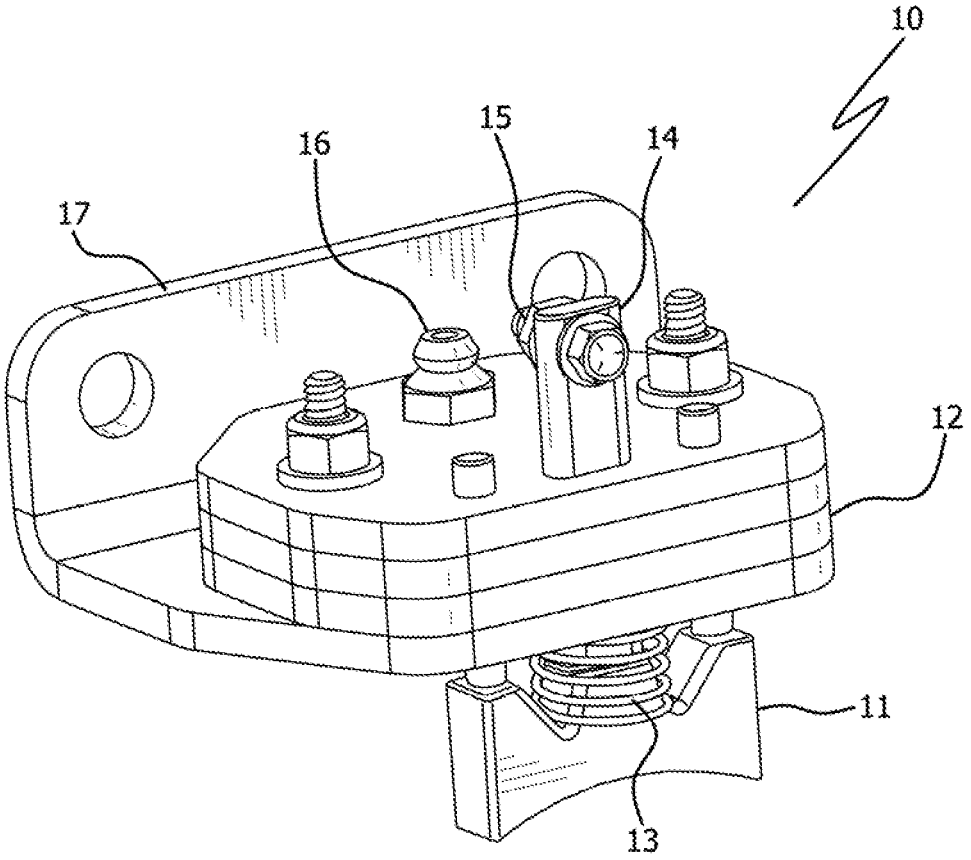
FIG. 2 is a perspective view of the shunt assembly of the present invention.
Figure 3:
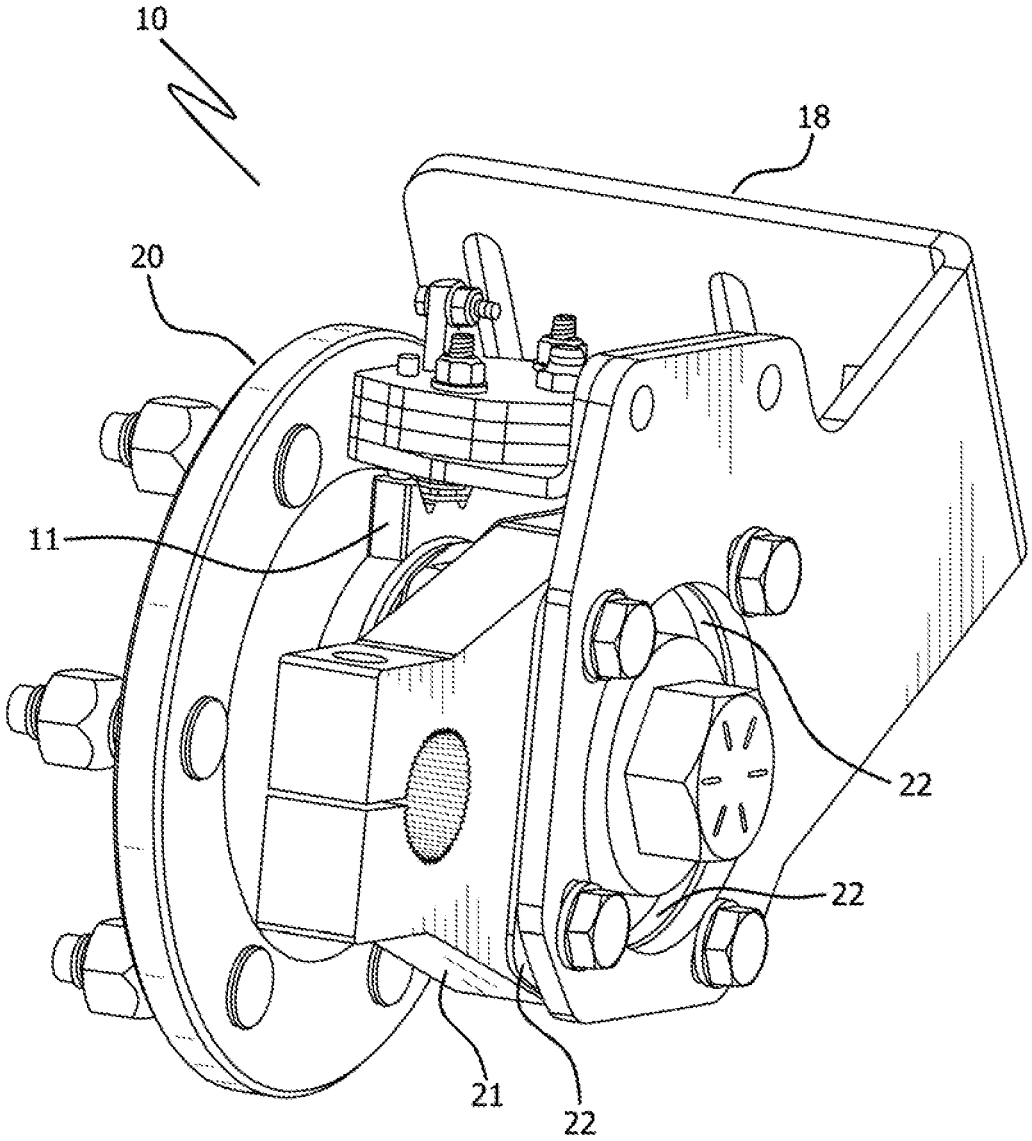
FIG. 3 is a perspective view of an entire assembly for a rail wheel of the present invention.

FIG. 2 is a perspective view of the shunt assembly 10 of the instant invention. Conductive contact shoe 11 having a concave base (as shown in FIG. 2 as the preferred embodiment, and also in FIG. 5*a*) is connected through grease housing plates 12 and is biased with coil spring 13 to maintain contact pressure on the hub 20 (as shown in FIG. 3) of the train wheel (which wheel is not shown in FIG. 3). Contact shoe 11 extends through plates 12 with a distal end 14 having a fastener set 15 in the form of a nut and bolt extending through said distal end 14. Grease fitting 16 is used to lubricate housing plates 12 and mounting plate 17 is used to attach shunt assembly 10 to rail sweep mounting bracket 18 as shown in FIG. 3.

Figure 1A:
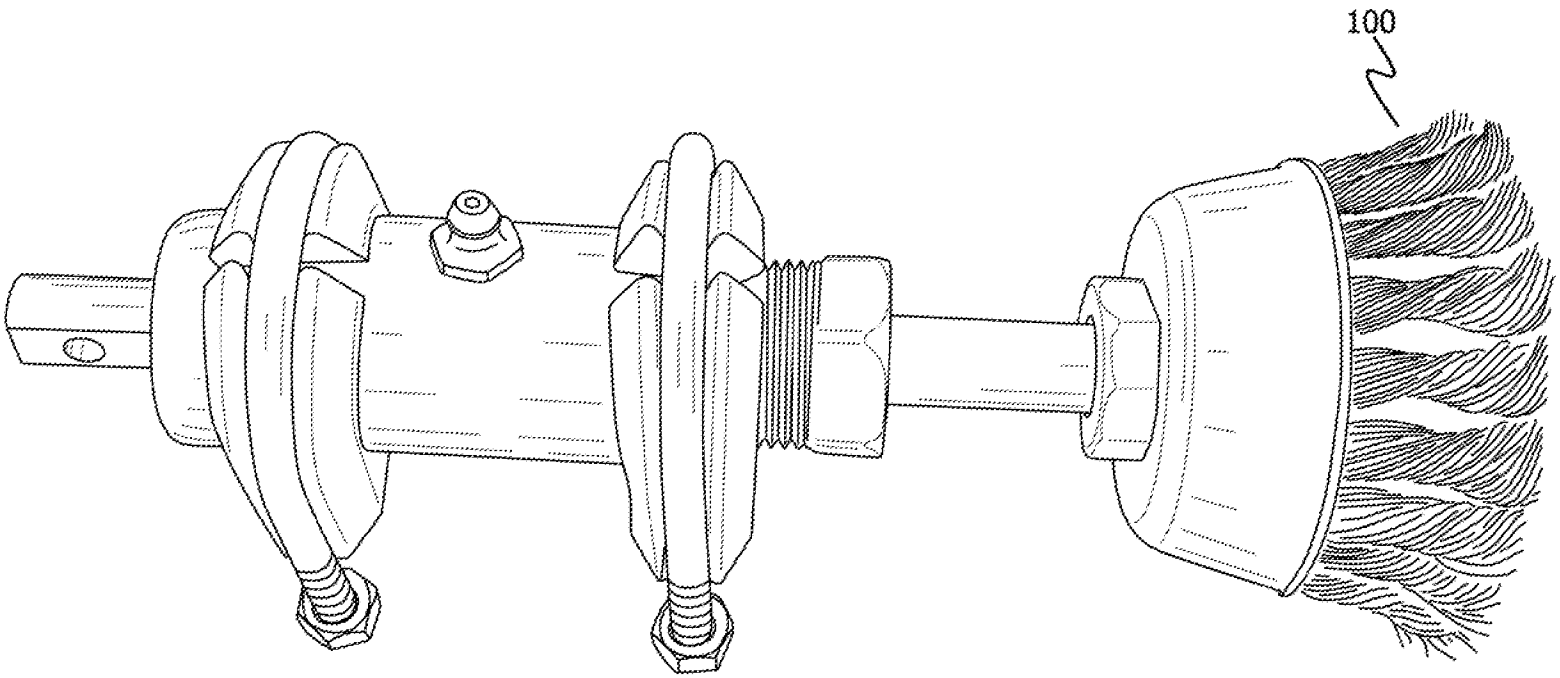
FIG. 1a (Prior Art)
FIGS. 1*a*, 1*b*, and 1*c* illustrate the prior art use of wire brushes to complete an electrical circuit between a spinning rail wheel and a control system for safety at railroad grade crossings.
Figure 1B:
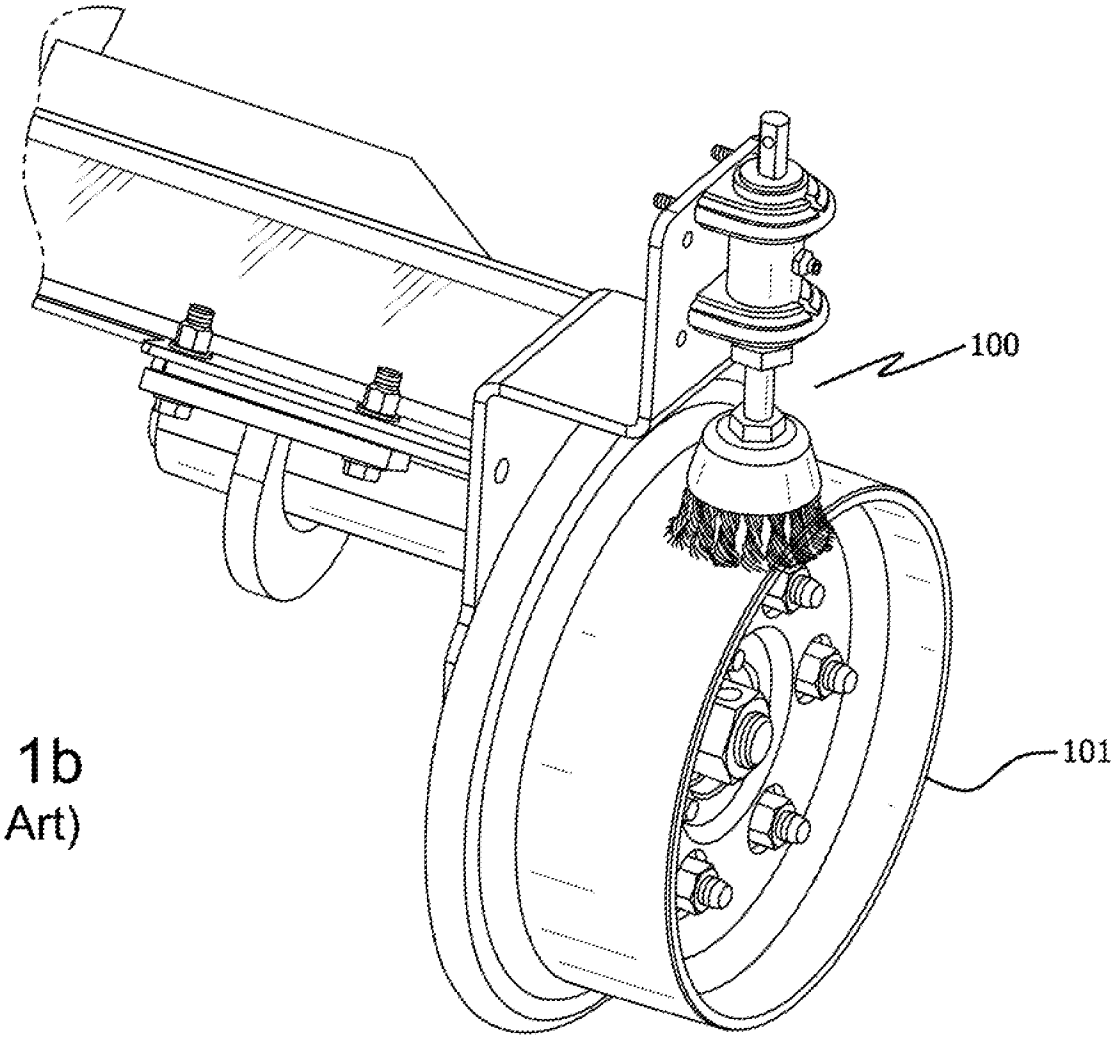
FIG. 1b (Prior Art)
Figure 1C:
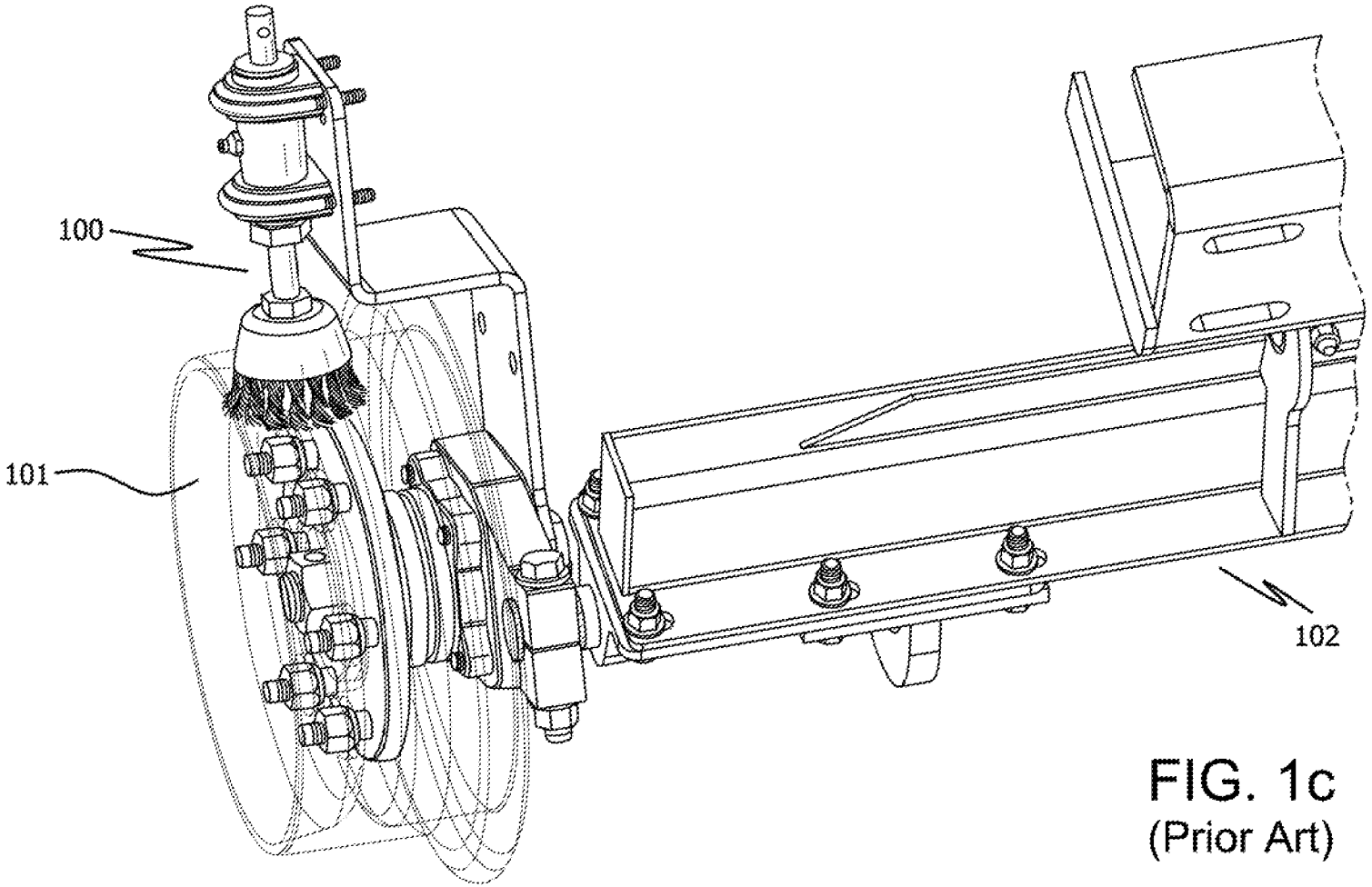
FIG. 1c (Prior Art)

FIG. 3 is a perspective view of the entire assembly for a rail wheel (which wheel is not shown, but would be similar to prior art element 101 as shown in prior art FIGS. 1*b* and 1*c*) as it is connected to rail gear (not shown, but similar to prior art element 102 in prior art FIG. 1*c*). Visible in FIG. 3 is rail wheel hub 20 on which contact shoe 11 rides. Conductive contact shoe 11 in the preferred embodiment is manufactured from cast 304L stainless steel, a relatively soft conductive material so as to minimize wear on hub 20. Wheel arm 21 connects wheel hub assembly 20 to rail gear (not shown) by white plastic insulators 22 that electrically insulate wheel hub assembly 20 from rail gear so that the sole electrical path in the system is through shunt assembly 10.

Figure 4:
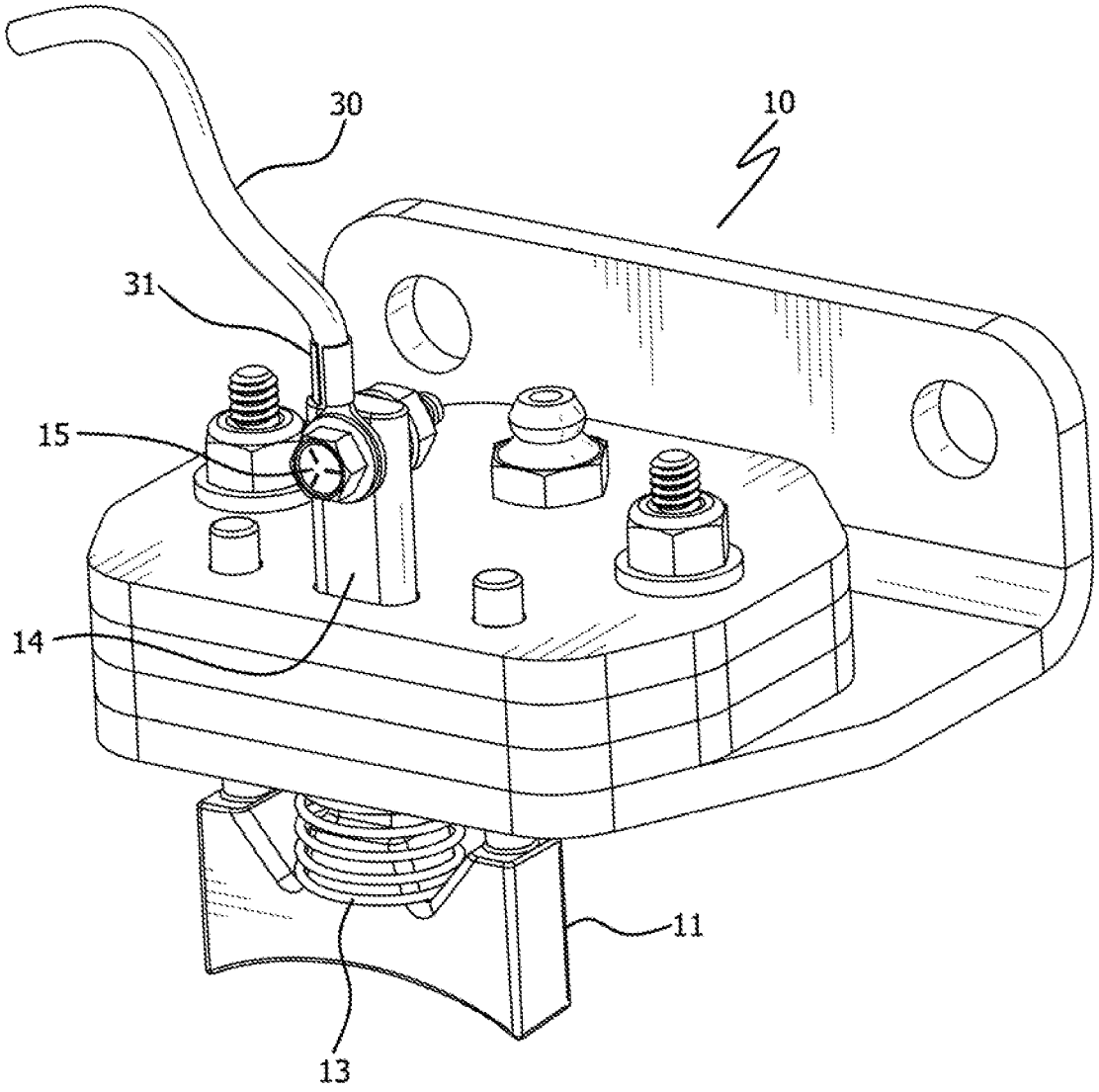
FIG. 4 is a perspective view of a shunt assembly of the present invention.

FIG. 4 is a perspective view of shunt assembly 10 showing wire 30 connected by eye ring 31 that is attached to fastener set 15 on distal end 14 of contact shoe 11 completing the electrical connection from electrified track (not shown) through the rail wheel riding on such electrified track through conductive contact shoe 11 to wire 30 which forms a shunt to complete the electrical circuit to control the gate crossing signals and gates.

Figure 5A:
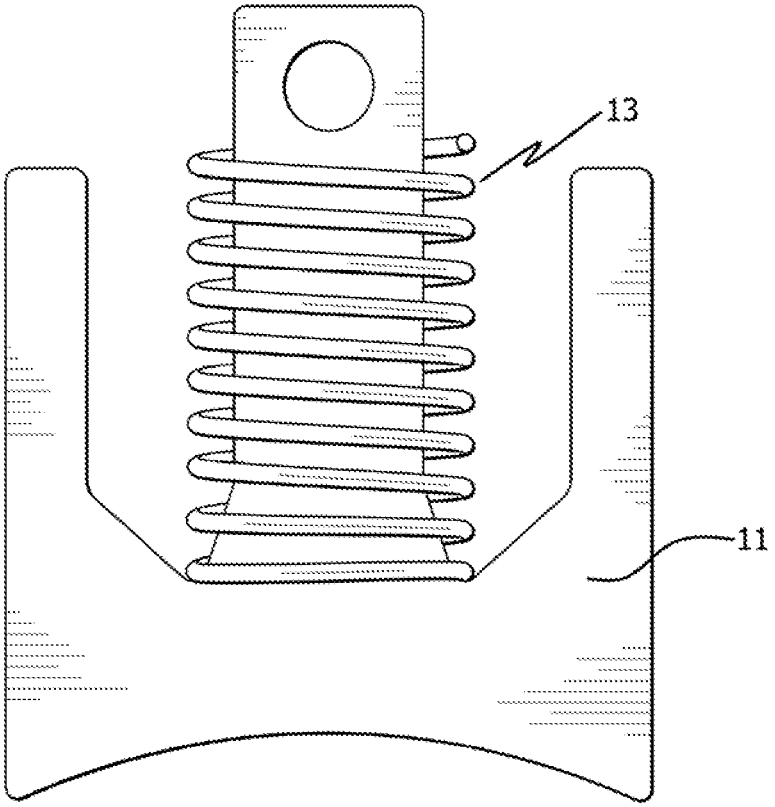
FIG. 5*a* shows the preferred embodiment of a conducive contact shoe of the present invention.
Figure 5B:
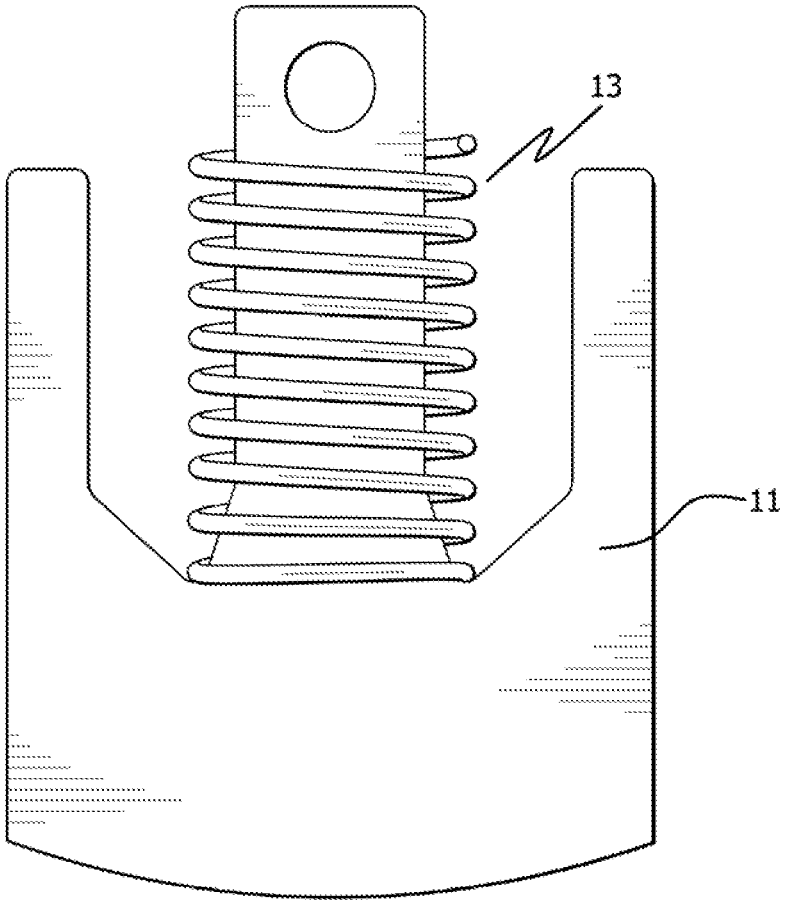
FIGS. 5*b*, 5*c*, and 5*d* show alternate embodiments of a conducive contact shore of the present invention.
Figure 5C:
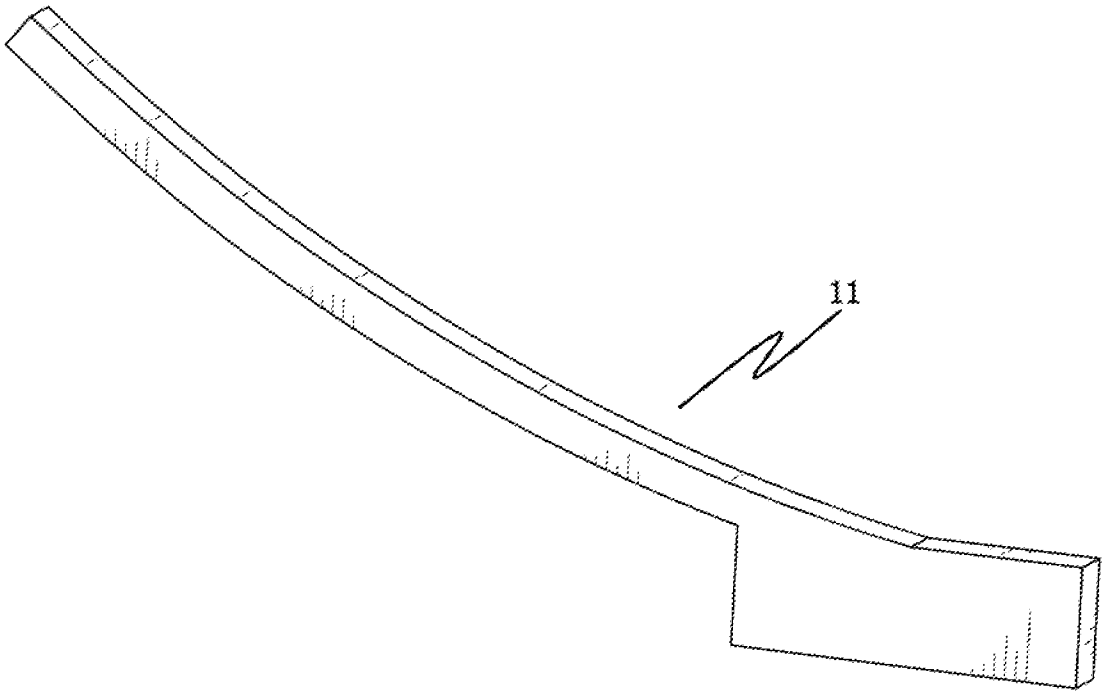
Figure 5D:
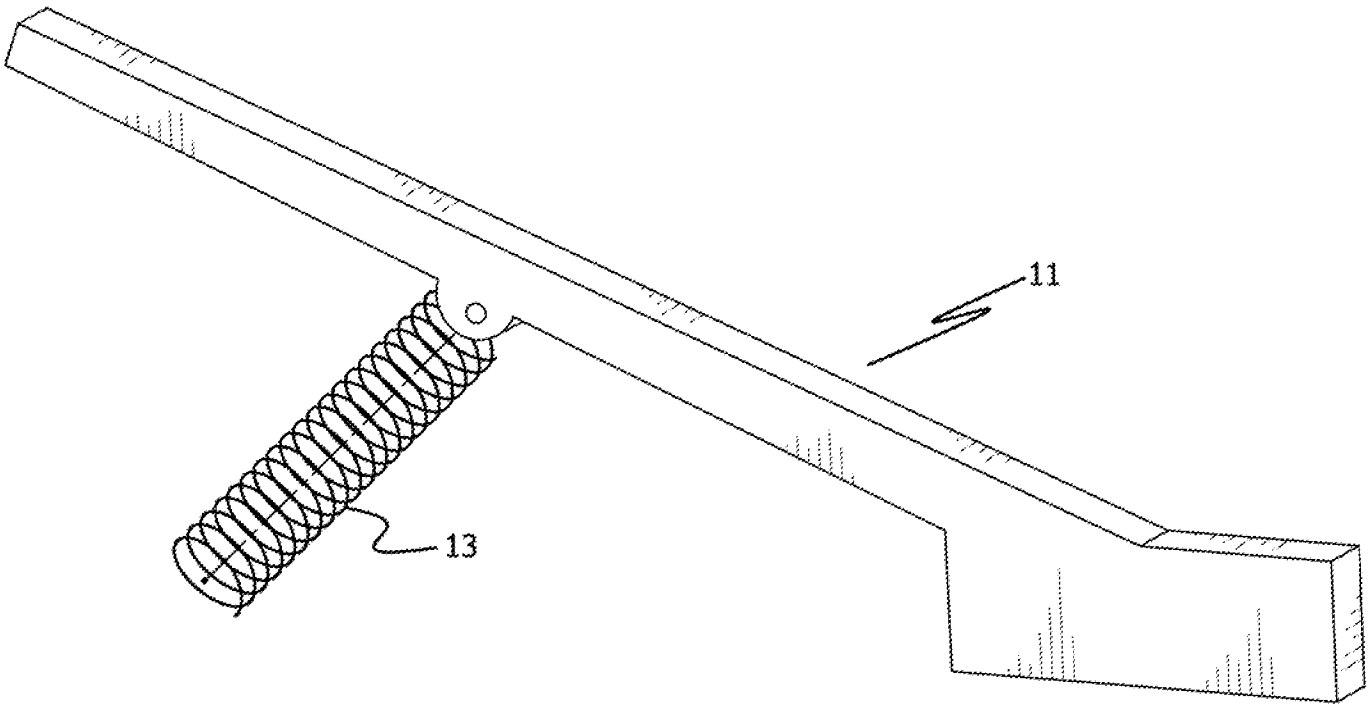

FIG. 5*a* shows the preferred embodiment of the conducive contact shoe 11, in its concave form, with coil spring 13. FIGS. 5*b*, 5*c*, and 5*d* show alternate embodiments of contact shoe 11 and spring 13, which alternate embodiments are to be construed to be covered by this disclosure.

What is claimed is:

1. In a system for providing safety signals at grade crossings of electrified railroad track using a shunt assembly installed on a car riding on said railroad track to complete an electrical circuit between a rail wheel of said vehicle and said track, the improvement comprising:

a conductive contact shoe;

a spring, whereby the position of said contact shoe is biased by said spring so as to be in continuous contact with said rail wheel riding on said track in order to complete said electrical circuit;

a rail sweep mounting bracket connected to an undercarriage of said vehicle;

a wheel arm connected to said bracket;

a wheel hub assembly connected to said wheel arm;

rail gear having a hub connected to said wheel hub assembly; and stacked housing plates connected to said mounting bracket, whereby said conductive contact shoe contacts said hub and is connected to said stacked housing plates and said spring is positioned between said contact shoe and said stacked housing plates.

2. A shunt assembly for use in a control system for signals at electrified railroad track grade crossings comprising:

a rail sweep mounting bracket connected to an undercarriage of a car riding on said railroad track;

a wheel arm connected to said bracket;

a wheel hub assembly connected to said wheel arm;

rail gear having a hub connected to said wheel hub assembly;

housing plates connected to said mounting bracket;

a conductive contact shoe extending through said housing plates; and a spring positioned between said contact shoe and said housing plates, whereby said spring acts to bias the position of said contact shoe with respect to said wheel hub so that said contact shoe is in continuous contact with said wheel hub.

3. The shunt assembly of claim 2 in which the base of said conductive contact shoe is concave in form.

4. The shunt assembly of claim 2 in which said conductive contact shoe is manufactured using cast 304L stainless steel.

* * * * *